United States Patent [19]

Rodolfi

[11] 4,100,517

[45] Jul. 11, 1978

[54] ELECTRICAL CONTACTORS

[75] Inventor: Giorgio Rodolfi, Varese, Italy

[73] Assignee: Bassani Ticino S.p.A., Milan, Italy

[21] Appl. No.: 764,452

[22] Filed: Jan. 31, 1977

[30] Foreign Application Priority Data

Feb. 6, 1976 [IT] Italy ..... 304 A/76

[51] Int. Cl.[2] ..... H01H 50/04

[52] U.S. Cl. ..... 335/132; 335/202

[58] Field of Search ..... 335/132, 202, 160

[56] References Cited

U.S. PATENT DOCUMENTS

| | | | |
|---|---|---|---|
| 3,215,800 | 11/1965 | Hurter et al. | 335/132 |
| 3,382,469 | 5/1968 | Conner | 335/132 |

*Primary Examiner*—Harold Broome

*Attorney, Agent, or Firm*—Michael J. Striker

[57] ABSTRACT

An electrical contactor comprises a rectangular base carrying at least one pair of spaced fixed contacts. A movable support element carrying movable contacts is disposed on the base. A prismatic casing open at both ends is disposed on the base. A solenoid disposed within and supported by the casing comprises a movable armature having two parallel legs directed towards the base with their free ends resting on the movable support element. Two arms are hinged to the base near diagonally opposed corners of the base and have inwardly-directed projections arranged to engage diagonally opposed corners of the end of the casing remote from the base when the arms are pivoted against the casing. The inwardly-directed projections are provided with threaded holes. A cover plate can be superimposed over the end of the casing remote from the base and over the projections, the cover plate being provided with holes in register with the threaded holes when the arms are pivoted against the casing whereby screws can be passed through the holes and engaged within the threaded holes to lock together the above-mentioned parts of the contactor. The cover plate is provided with an aperture giving access to a push-button connected to the armature. One or more additional elements can be mounted on a side or sides of the casing to be locked between the base and cover plate. The additional member may be a cover element, an auxiliary switch/contact set assembly, or a structure for interconnecting the contactor and a juxtaposed, like contactor to prevent the two contactors from being operated at the same time.

7 Claims, 8 Drawing Figures

ELECTRICAL CONTACTORS

BACKGROUND OF THE INVENTION

1. Field of the Invention

This invention relates to electrical contactors.

2. Discussion of the Prior Art

A known electrical contactor comprises a base carrying fixed contacts, a corresponding number of movable contacts mounted on a support, a casing mounted on the base, a solenoid disposed in the casing and causing closure of the contacts when energized by an electric current passing through it, and a cover plate superimposed on the casing, said cover plate being provided with an aperture providing access to a push-button for manually closing the contacts.

The structure of the known electrical contactor is complicated and makes it time-consuming to mount or disassemble the components of the contactor both during production and in maintenance operations.

SUMMARY OF THE INVENTION

A main object of the present invention is to provide an electrical contactor having a simple structure permitting a substantial reduction of the working time required for assembling and disassembling the contactor during production, installation, and maintenance.

According to the present invention an electrical contactor comprises a rectangular base carrying fixed contacts, a casing resting on the base and open toward the base and at an opposed end, the casing containing and supporting a solenoid, two arms each hinged at one end to the base and having its other end an inwardly-directed projection arranged to be superimposed on a respective corner of the end of the casing remote from the base, each projection being provided with a threaded hole, and a cover plate capable of closing the end of the casing remote from the base and having two diagonally opposed holes in register with the threaded holes of the projections to allow the passage and the tightening of respective screws by means of which the base, the casing and the cover plate can be locked together.

A preferred embodiment of the invention comprises hook means disposed at least on one side of the base for interchangeably mounting an additional element positioned adjacent a side wall of the casing, the hook means being movable with an armature of the solenoid to actuate electrical equipment contained in the additional element, the hook means allowing quick assembly and disassembly of the additional elements.

BRIEF DESCRIPTION OF THE DRAWINGS

An electrical contactor embodying the invention will now be described, by way of example, with reference to the accompanying drawings, wherein.

DETAILED DESCRIPTION OF THE PREFERRED EMBODIMENT

Figure 1:
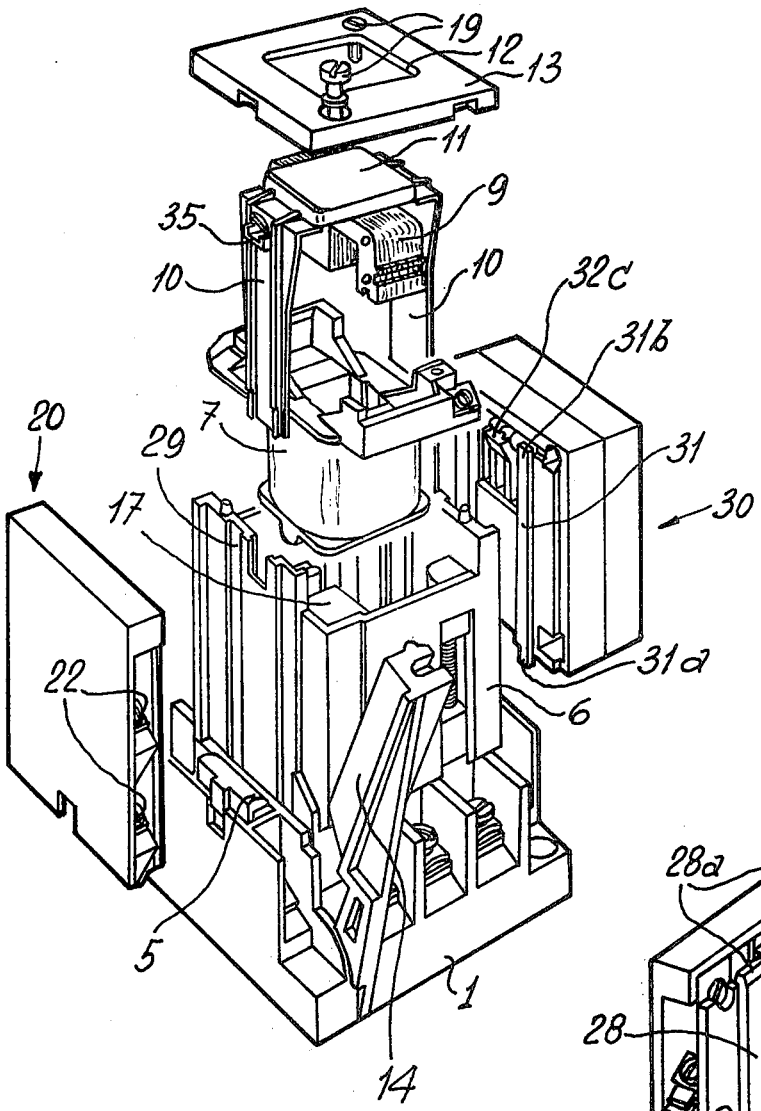
FIG. 1 is an exploded perspective view of the contactor.
Figure 8:
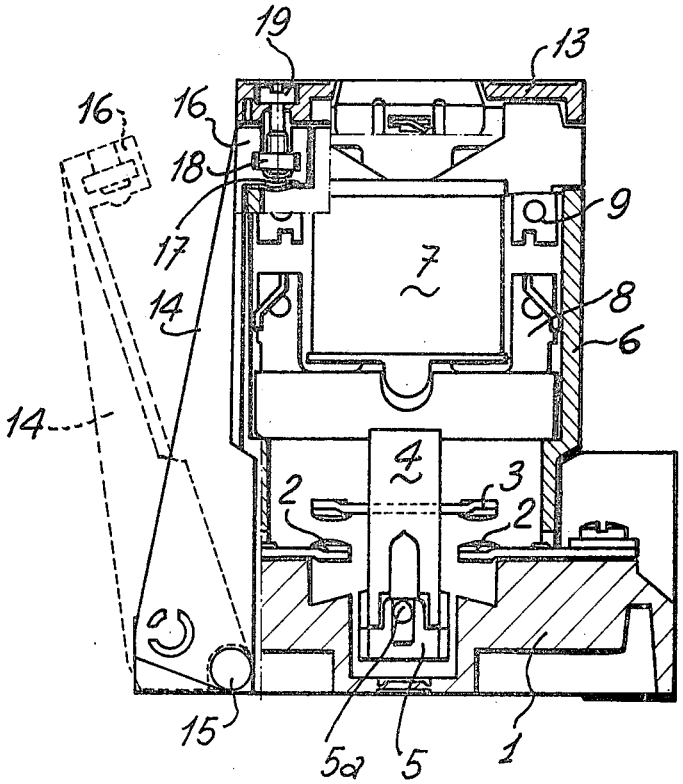
FIG. 8 is a cross-section of the contactor of FIG. 1 in the assembled condition.

Referring particularly to FIGS. 1 and 8, an electrical contactor, embodied in this case as a three-phase contactor, comprises a base 1 carrying three pairs of fixed contacts 2, in correspondence with which respective movable contacts 3 are provided. The movable contacts 3 are carried by a support element 4 movable vertically so as it may be displaced by energization of a solenoid described below from the position shown in FIG. 8, wherein the movable contacts 3 are spaced from the fixed contacts 2, to a position wherein the movable contacts 3 are pressed against the fixed contacts 2. The support element is biased towards the position shown in FIG. 8 by elastic means (not shown).

The support element 4 rests at its sides or ends on inwardly directed lugs 5*a* formed on two opposed hooks 5 which are slidably mounted on a pair of opposed sides of the base 1 so that they will slide downwardly under the pressure exerted by the support element 4 when the latter is displaced by the electromagnetic relay, and will slide upwardly when the electromagnetic relay is deenergized under the action of spring elements (not shown).

Figure 2:
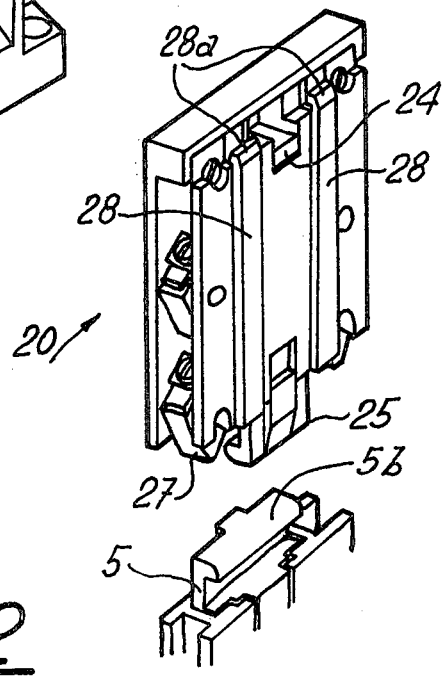
FIG. 2 is a perspective view of a first interchangeable additional element forming part of the structure shown in FIG. 1.

As shown in FIG. 2, each hook 5 is provided with a hook member 5*b* directed inwardly relative to the base 1, which serves both for the engagement of an additional element (described hereinbelow) and for the operation of electrical equipment such as auxiliary contacts and an associated auxiliary switch that may be enclosed in the additional element.

On the base 1 is mounted a casing 6 having a prismatic shape and disposed with its axis perpendicular to the plane of the base 1, the casing 6 being open at its lower and upper ends. Within the casing 6 is contained and supported the above-mentioned solenoid, which comprises a coil 7, a frame 7′ supporting the coil 7 and designed to rest on the upper edge of the casing 6, a fixed magnetic yoke 8 and a movable armature or keeper 9. Two parallel, opposed legs 10 are directed downwardly from the armature 9 and are so spaced from each other that they embrace the frame 7′ and the coil 7. The free ends of the legs 10 rest on the support element 4, whereby the armature 9 may operate the support element 4 by means of the legs 10 when the coil 7 is energized, causing closure of the movable contacts 3 against the fixed contacts 2.

A push-button 11 is provided above the keeper 9. Pressure on the push-button 11 displaces the armature 9 and the legs 10 from a position where the armature is attracted against the yoke 8, at which position the contacts 2, 3 are separated, to displace the support element 4 to the position in which the contacts 2, 3 are closed. The push-button 11 is accessible through an aperture 12 formed in a cover plate 13 arranged to cover the open upper end of the casing 6.

On the base 1, near a pair of diagonally opposed corners, pivotable arms 14 are provided, only one of which is shown in FIGS. 1 and 8. Each arm 14 is provided at its lower end with a pin 15 by means of which it is hinged to a seat formed in the base 1, so that the arm may be pivoted around the axis of the pin. The upper end of each arm 14 is provided with an inwardly-directed projection 16 disposed at a level such that when the arm is pivoted from the position shown in FIG. 8 by dotted lines to the position shown in FIG. 8 by solid lines it will be superimposed on a respective one of a pair of diagonally opposed corners of the upper edge of the casing 6 and superimposed on a web 17 formed in such corner. The projection 16 is provided with a threaded hole, preferably formed by a shrouded nut 18. The cover plate 13 is designed also to cover the projections 16 and is provided with holes in register with the threaded holes of the projections 16, whereby a pair of screws 19 may be passed through the holes in the cover plate for engagement within the threaded holes. Engagement of the screws 19 in this way provides locking together of the various parts of the structure described above.

The arms 14 are so shaped that they contribute to the prismatic shape of the structure described above.

If desired, interchangeable additional elements may be mounted on one or each of the pair of opposed sides of the structure shown in FIG. 1 where the hook means 5 are provided. The additional elements may serve only as cover elements or they may incorporate electrical equipment, such as an auxiliary switch with associated auxiliary contacts. By way of example, the contactor is shown in FIG. 1 as having mounted on one side an additional element 20 as described hereinbelow with reference to FIGS. 2 to 4, and as having mounted on the opposed side an additional element 20 as described hereinbelow with reference to FIGS. 5 to 7.

Figure 3:
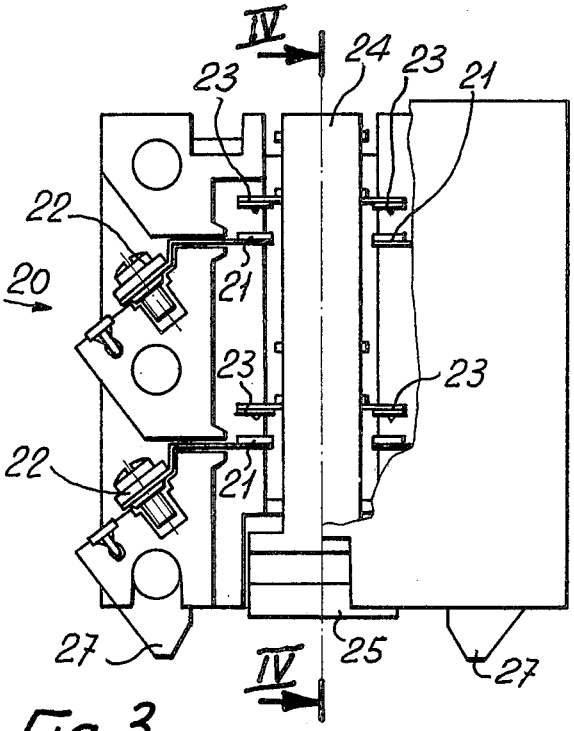
FIG. 3 is a front view with portions cut away of the additional element of FIG. 2.
Figure 4:
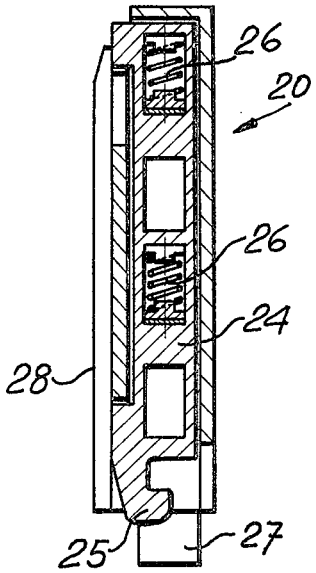
FIG. 4 is a cross-section taken along the line IV—IV of FIG. 3.

The additional element 20, including an auxiliary switch with auxiliary contacts, is shown in FIGS. 2, 3 and 4. The additional element 20 is constituted by a flat box-shaped body enclosing two pairs of fixed contacts 21 electrically connected to respective terminals 22 accessible by way of the opposed, open sides of the body. The additional element 20 also includes therewithin two pairs of movable contacts 23 which are carried by an elongate movable support 24, provided at its lower end with a counter-hook 25 capable of being engaged by the associated hook member **5*b***.

Displacement of the elongate movable support 24 is damped by a pair of coil springs 26 housed in respective internal seats: see FIG. 4.

At its lower edge, the additional element 20 is provided with two projections 27 designed to be accommodated in respective seats (not shown) in the base 1.

When the additional element 20 is mounted in position, the counter-hook 25 is engaged by the associated hook member **5*b* while the projections 27 are received in their respective seats in the base 1. The additional member 20 is provided on its inner side with two ribs 28 (FIG. 2) that enter respective grooves 29 on the corresponding side wall of the casing 6. The ribs 28 project upwardly with their upper ends 28*a* designed to be received in recesses provided on the cover plate 13, whereby the additional element is locked in place when the screws 19** are tightened.

Figure 5:
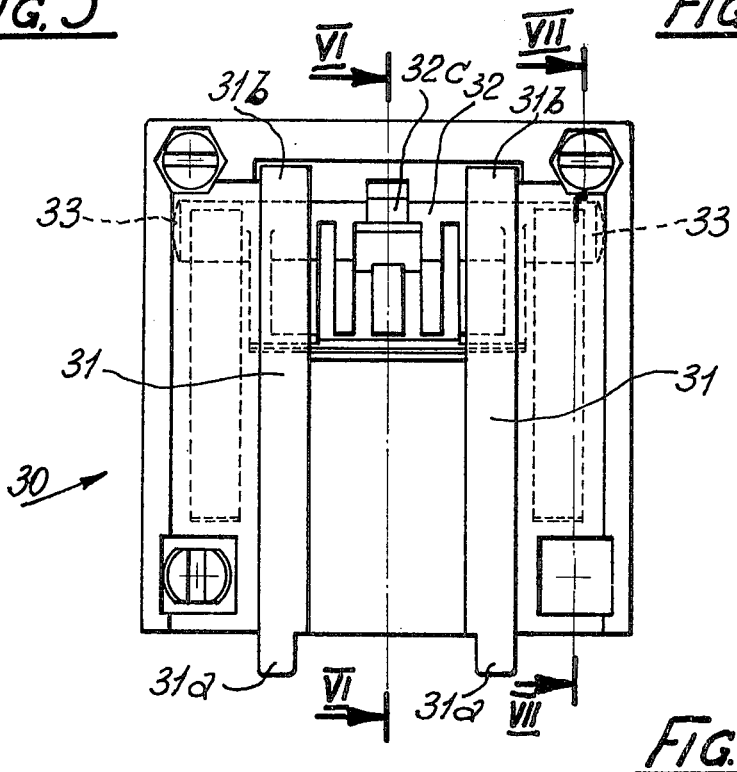
FIG. 5 is a front view of a second interchangeable additional element forming part of the structure shown in FIG. 1.
Figure 6:
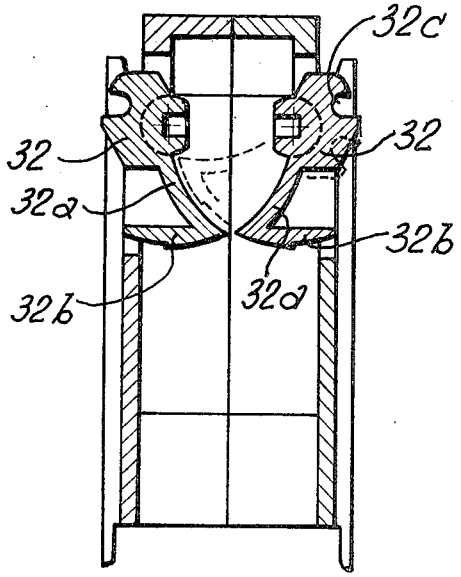
FIG. 6 is a cross-section taken along the line VI—VI of FIG. 5.
Figure 7:
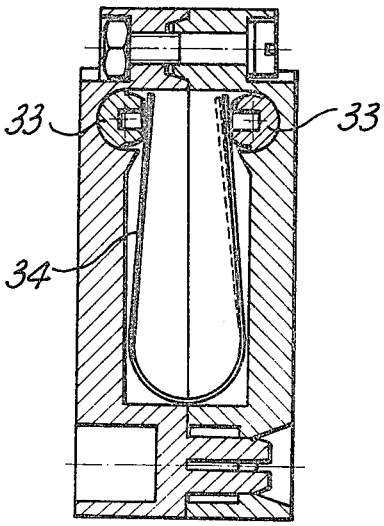
FIG. 7 is a cross-section taken along the line VII—VII of FIG. 5.

The connecting element 30 shown in FIGS. 5, 6 and 7 is designed to mechanically connect two, like juxtaposed electrical contactors such that only one contactor may be operated at a time, i.e. such that both of the electrical contactors may not be operated simultaneously.

The connecting element 30 is constituted by a box-shaped body similar to that of the additional element 20, but having a greater thickness.

The connecting element 30 has parallel ribs 31 provided on both the parallel side faces thereof, the ribs 31 being designed to enter the corresponding grooves 29 of the casings 6 of two juxtaposed electrical contactors each as described with reference to FIGS. 1 and 8. The ribs 31 have projecting lower ends **31*a* and projecting upper ends 31*b*, which may be engaged within respective recesses in the base 1 and in the inside of the cover plate 13, respectively, to afford locking of the connecting element 30** to the structures of each of the two juxtaposed electrical contactors.

Inside the connecting element 30, as shown in FIG. 6, two pivotable members 32 are disposed symmetrically with respect to the central plane of the element 30. The pivotable elements 32 (FIGS. 5 and 7) are provided with rounded ends 33 inserted into respective seats defined by the box-shaped body. The ends 33 may rotate to a limited extent within their respective seats, whereby the elements 32 may be pivoted by a limited amount around respective axes parallel to each other. The ends 33 are elastically held in their respective seats by means of a leaf spring 34 (FIG. 7) bent into a U-shape.

As is clearly shown in FIG. 6, each pivotable element 32 is configured to comprise an arcuate portion **32*a* terminated by a horizontal terminal portion 32*b* having its outer face convexly arcuate, so that when one of the elements is rotated the terminal portion 32*b* thereof is superimposed over the inner face of the arcuate portion 32*a* of the other element 32**, preventing the latter from rotating.

Moreover, each pivotable element 32 is provided with an outwardly-facing recess **32*c*, the recess 32*c* being designed to receive a projection 35 (FIG. 1) provided on the upper portion of a said leg 10**.

In this way, when the push-button 11 of one contactor is operated, the displacement of the legs 10 and of the associated projection 35 causes rotation of the pivotable element 32 engaged by such projection, whereby the other oscillating element 32 is locked in place and consequently the projections 35, the legs 10 and the armature 9 of the juxtaposed electrical contactor are locked against movement whereby that contactor cannot be operated.

As mentioned above, instead of the additional elements 20 or 30, it is possible to employ an additional element having only a covering function. The additional covering element (not shown) has the same box-shaped body as the additional element 20, the body not enclosing electrical equipment.

Assembly of the structure described above is carried out as follows.

The movable support element 4, provided with the movable contacts 3, is disposed on the base 1. The casing 6, already fitted with the yoke 8, is then applied to the base 1 and, thereafter, the coil 7 and the frame 7' are put in place with the latter resting on the upper edge of the casing 6. The armature 9 with the legs 10 is then inserted into the casing 6 until the free ends of the legs 10 rest on the movable support element 4.

The arms 14 are then swung from the inclined outward positions, as shown for one of them in dotted lines in FIG. 8, to the position shown in solid lines in FIG. 8, thereby temporarily or provisionally locking the casing 6 in place. The additional elements 20 and/or 30 and/or the cover element are then applied in the manner described above and the whole assembly is locked together by applying the cover plate 13 and by tightening the screws 19.

It is evident that partial or total disassembly of the contactor for maintenance purposes is quickly achieved by unscrewing the screws 19 and removing the cover plate 13, whereupon any component element may be removed. More generally, the working time required for assembling and disassembling the contactor during production, installation and maintenance is greatly reduced as compared to that for conventional contactors.

I claim:

1. An electrical contactor comprising a rectangular base carrying at least one pair of spaced fixed contacts, a movable support element carrying movable contacts and disposed on said base, a prismatic casing disposed on said base with its axis perpendicular to said base and having its respective ends open, a solenoid disposed within and supported by said casing and comprising a movable armature having two parallel legs directed towards said base with their free ends resting on said movable support element, two arms hinged to said base near a pair of diagonally opposed corners of the base and having inwardly-directed projections arranged to engage a pair of diagonally opposed corners of the end of said casing remote from said base when said arms are pivoted against said casing, said inwardly-directed projections being provided with threaded holes, a cover plate capable of being superimposed over the end of said casing remote from said base and over said inwardly-directed projections, said cover plate being provided with holes in register with said threaded holes when said arms are pivoted against said casing whereby respective screws can be passed through said holes and engaged within said threaded holes to lock together the above-mentioned parts of the contactors, a push-button connected to said movable armature, and an aperture defined by the cover plate and providing access to said push-button.

2. An electrical contactor according to claim 1, comprising an interchangeable additional element mounted on a side of said casing and lockable between said base and said cover plate.

3. An electrical contactor according to claim 2, comprising two said additional elements mounted on opposite sides of said casing.

4. An electrical contactor according to claim 2, wherein said additional element is a cover element.

5. An electrical contactor according to claim 2, wherein a movable hook member is mounted on said base for movement with said movable support element supporting said movable contacts of the contactor, and wherein said additional element comprises a flat box-shaped body containing auxiliary contacts and an associated auxiliary switch having a movable element, said movable element of said auxiliary switch being provided with a counter-hook engageable by said hook member.

6. An electrical contactor according to claim 2, wherein said additional element comprises an interconnecting element arranged to connect the electrical contactor to a juxtaposed electrical contactor.

7. An electrical contactor according to claim 6, wherein said interconnecting element is constituted by a box-shaped body containing two elements each rotatable by a limited amount around a respective parallel axis, said two elements being engageble with each other such that when one of the elements is rotated the other element is locked in place, each said element being connectable to a projection projecting from a said leg of the movable armature of the associated contactor, whereby the locked element prevents operation of the associated electrical contactor.

* * * * *